US006778673B1

(12) United States Patent
Hobelsberger

(10) Patent No.: US 6,778,673 B1
(45) Date of Patent: Aug. 17, 2004

(54) TUNABLE ACTIVE SOUND ABSORBERS

(76) Inventor: Maximilian Hans Hobelsberger, Dorfstr. 16, Wuerenlingen (CH), CH-5303

( * ) Notice: Subject to any disclaimer, the term of this patent is extended or adjusted under 35 U.S.C. 154(b) by 0 days.

(21) Appl. No.: 09/419,576

(22) Filed: Oct. 18, 1999

Related U.S. Application Data

(60) Provisional application No. 60/106,041, filed on Oct. 28, 1998.

(51) Int. Cl.[7] ..... H04R 3/00
(52) U.S. Cl. ..... 381/96
(58) Field of Search ..... 381/96, 71.1, 71.7

(56) References Cited

U.S. PATENT DOCUMENTS 4,297,538 A * 10/1981 Massa ..... 381/340
5,119,427 A * 6/1992 Hersh et al. ..... 381/71.14
5,173,575 A * 12/1992 Furukawa ..... 181/148
5,210,383 A * 5/1993 Noxon ..... 181/290
5,598,479 A * 1/1997 Dodt et al. ..... 381/71.7
5,778,081 A * 7/1998 Patrick ..... 381/71.5
5,812,686 A * 9/1998 Hobelsberger ..... 381/96
5,919,029 A * 7/1999 Van Nostrand et al. ..... 181/206
6,088,459 A * 7/2000 Hobelsberger ..... 381/96
6,151,396 A * 11/2000 Maier ..... 381/71.14
6,385,321 B1 * 5/2002 Krueger et al. ..... 381/71.7

* cited by examiner

*Primary Examiner*—Minsun Oh Harvey
*Assistant Examiner*—Brian Pendleton

(57) ABSTRACT

The sound absorber is a combination of an acoustical transformer with an actively simulated acoustical impedance. The acoustical transformer transforms the high active impedance into a low impedance at the mouth of the transformer. The absorber is tuned by changing the active impedance.

21 Claims, 3 Drawing Sheets

TUNABLE ACTIVE SOUND ABSORBERS

This application claims the benefit of Provisional application Ser. No. 60/106,041, filed Oct. 28, 1998.

BACKGROUND OF THE INVENTION

1. Field of the Invention

This invention relates to devices which absorb noise. More particularly, the invention relates to an active sound absorbing system with tunable resonators.

2. Prior Art

In some applications in the field of acoustics devices are needed which reflect or absorb acoustical waves in a specified way. Often these devices should not reflect any acoustical waves and absorb the acoustic energie.

At high frequencies this specified behaviour, e.g. no reflection, can be achieved by simple, passive constructive means, i.e. the of use absorptive materials like foam rubber or glass wool, and by giving the non-reflecting surface a special shape. However at low frequencies the dimensions of absorptive structures get large and impractical.

Active devices which absorb sound are described in e.g. the patents DE4027511 (Mechel),. U.S. Pat. No. 5,812,686 (Hobelsberger), U.S. Pat. No. 5,498,127 (Kraft), which all describe variations of devices with actively simulated acoustic impedances. A more general description of sound absorption can be found in the book "The Active Control of Sound" (P. A. Nelson & S. J. Elliot, Academic Press).

The above mentioned devices may be called devices for simulation of acoustical impedances. The working principle of these devices is the following: At the membrane of an electroacoustical transducer the air pressure is measured by measuring means, e.g. pressure sensors. Based on this measured values the transducer's membrane is moved by the transducer's driving means with a certain speed. This speed is calculated based on the measured pressure according to a desired impedance, function. This impedance function describes the dependancy of the speed on the pressure and time, including the momentary pressure value and the pressure's historical values. Usually this relation will be described as a system of differential equations in the time domain, or as a transfer function in the frequency domain (the resulting Laplace transformated function).

A different approach for an active absorber is described in the patent U.S. Pat. No. 5,119,427 (Hersh et al.). This absorber is constructed as tunable Helmholtz absorber. It is tuned by feeding acoustical waves of appropriate frequency into the resonator chamber. The pressure at the membrane or within the chamber is not measured. To determine the appropriate frequency, phase and amplitude of the acoustical waves to tune the resonator a microphone is placed outside of the chamber which measures the reflections.

SUMMARY OF THE INVENTION

One problem at the above mentioned active acoustic absorbers (i.e. patents of Mechel, Kraft, Hobelsberger) is to build the suitable electroacoustic transducer. In principle the membrane at these absorbers should behave like a layer of air: Even small forces should cause large excursions. At low frequencies an electrodynamic transducer, e.g. a moving coil transducer, is well suited. At low frequencies the membrane's acceleration values are somehow modest, and a large membrane may be used, even at large excursions.

However at higher frequencies the acceleration forces rise to prohibitive values, especially when considerable sound pressure values must be handled. Cone breakups of the transducer would cause disturbances. Additionally the membrane will wear out soon. Summarizing it can be said that a suitable, high excursion transducer for higher frequencies and higher sound pressures would be technically quite demanding and expensive.

In the above metioned patent specification U.S. Pat. No. 5,498,127 (Kraft) the use of e.g. piezoelectric transducers is proposed. However it is well known in the art that the excursion capabilities of piezo-transducers are very limited. So practically the piezo-transducers can only be used at low power applications in the higher frequency range. On the other hand piezo-transducers are simple, light devices with only a few moving parts. And they can handle high pressure waves. They would be favourable transducers for active absorbers.

It is one object of this invention to provide means which allow to use low-excursion transducers, e.g. piezo—transducers, even in high power, middle (e.g. 1 kHz) frequency applications of active absorbers over a broader frequency band.

An other object of the invention is to avoid the necessity to arrange microphons or other sensing means outside of the protected absorber chamber. This arrangement outside of the absorber itself is necessary at all so-called noise cancellation systems and at the device of the above mentioned patent U.S. Pat. No. 5,119,427 (Hersh et al.). It can be imagined that it is sometimes quite difficult to place sensors directly into machine ducts, e.g. within a turbine duct.

One important use of these devices is at aircraft turbines to reduce the emitted fan blade noise by absorbing the fan blade noise at the turbine's nacelle.

The basic feature of the invented devices is the application of acoustic transformers which are acoustically coupled to the internal transducer of the active sound absorber, i.e. of the device for simulation of an acoustical impedance. These acoustical transformers are shaped to transform the speed and pressure values of acoustical waves at the mouth or orifice of the acoustic transformer into lower speed, higher pressure values at the transducer's membrane within the absorber. So in fact the transformer is shaped to transform a preferable, higher acoustical impedance at the membrane of the device for simulation of an acoustical impedance into a lower acoustical impedance at the mouth of the transformer. These transformers allow to use relatively high simulated acoustical impedances by transformation of the high impedances into considerably lower impedances at the orifice. Or, more specific, the transformers allow lower speed values of the membrane of the acoustical transducer. In a further embodiment the transformer bundles the low excursion movement of a large membrane into a high excursion movement at the mouth of the acoustical transformer. An additional basic feature is that pressure sensing means are arranged within the acoustical transformer.

Another basic feature is that the absorber's absorption frequencies are tunable or adaptable during operation without the need for mechanical adaption due to the electronically adaptable simulated acoustical impedance.

Three basic types of acoustic transformers are known: The transmission line type transformer, the Helmholz resonator, and the acoustical horn. These three types can be further combined with each other. The acoustic transformer is used in the invented sound absorbers in combination with low excursion transducers, e.g. a piezo-electric transducer, to transform the low speed, high pressure waves at the surface of the piezo-transducer into lower pressure, higher speed waves at the mouth of the acoustic transformer. Of course other types of transducers (e.g. electrodynamic, electrostatic, magnetodynamic types) may be used too.

As described in the above mentioned patents (Mechel, Hobelsberger) the acoustical impedance (i.e. the relation between local pressure and flow velocity of the gas) at the transducer's membrane of the device for simulation of an acoustical impedance is actively controlled as follows:

Pressure sensing means, e.g. pressure sensors, are mounted within the acoustical transformer at, that means on or close to, the surface of the transducer's membrane to measure the air pressure at this location. "Close" means in this context acoustically close, that is usually less than 1/10 of the shortest acoustical wavelengths at which the device should work. The output signal of the pressure sensing means is conveyed to a calculator or model (both digital or analog or mixed), which delivers its output value to a controller. The controller controls via a power amplifier the movement, i.e. the speed, acceleration, or position and its derivatives, of the transducer's membrane. The controller forces the membrane to move in reaction to the measured air pressure at the membrane's surface with a speed according to the desired impedance function. This impedance function is used by the calculator or model to calculate input signals for the controller, e.g. the set point value for speed.

Models and calculators can be of the analog type, or of the digital type (e.g. using digital signal processors, DSP) with analog/digital converters and digital/analog converters as usually used for sound processing purposes. For superior speed control speed sensing means, i.e. a speed sensor, an accelerometer or a position measurement device, must be included to measure the speed of the membrane and gain information about the motional state of the membrane. The controller uses these measured speed values to effectively control the membrane's speed. The control scheme may be of the single channel type, or multivariable, multildop control schemes may be used (e.g. multivariable state-space controllers). In most cases this closed-loop speed control will be neccessary because cheap, light transducers with nonlinear, nonconstant behaviour and low damping will be used.

For a fuller understanding of the nature of the invention, reference should be made to the following detailed description of the preferred embodiments of the invention, considered together with the accompanying drawings.

DESCRIPTION OF THE PREFERRED EMBODIMENTS

Figure 1:
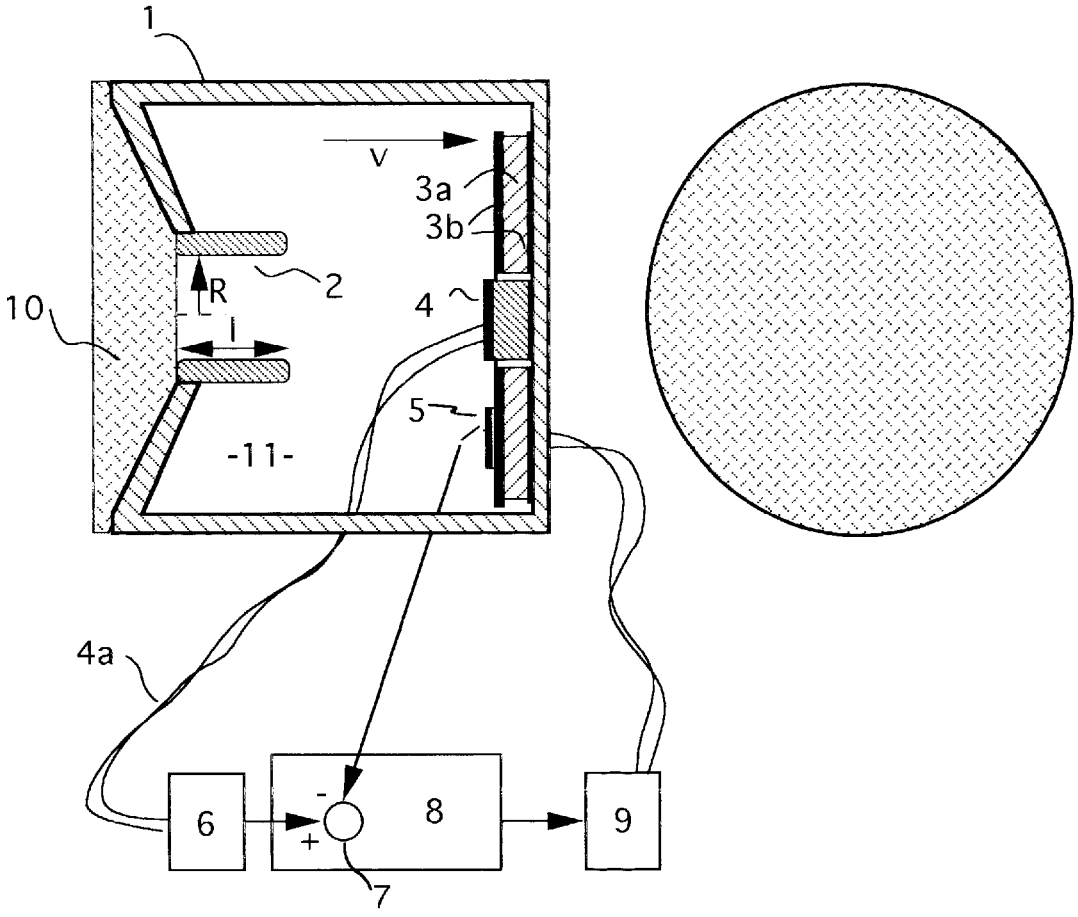
FIG. 1 is a schematic view of a system that is a preferred embodiment using a Helmholz resonator.

The following is a description of a first embodiment of the invention and refers to FIG. 1.

The device consists of a housing 1 which has an opening or orifice at one side. A sheet of foam or fibers 10 is arranged in the opening. The inside of the housing could be acoustically coupled to the outside by a light, movable membrane too. The orifice has a pipe-shaped structure 2 with a length l and a radius R. An electroacoustic transducer with a membrane 3*a* is arranged within the cavity 11 of the housing. In FIG. 1 this transducer is a piezoelectric transducer, consisting of a layer of piezoelectric meaterial 3*a* which is equipped with electrically conducting electrodes 3*b* on both surfaces. In FIG. 1 a thickness-mode transducer is shown, however usually it will be a bend-mode transducer. Any other electroacoustic transducer with sufficient displacement capability may be used too.

Speed sensing means 5 is arranged close to the membrane of the transducer 3 to measure the speed of the membrane. In FIG. 1 an accelerometer, attached to the membrane, is used to measure the speed.

The transducer's membrane is equipped with pressure sensing means 4 placed inside the cavity close to the membrane's front surface. The air pressure at the surface is measured by the sensing means. The signal produced by the sensing means is forwarded via wires 4*a* to a function block 6 which contains calculating means. In the function block 6 a calculation is performed based on a desired impedance function using the pressure sensing means output value as input value for the calculation. Based on the momentary pressure and the older pressure values a momentary output value is calculated which is forwarded to the controller's 8 subtracting block 7. The calculated output value determines how fast the membrane of the transducer should move. It is used as the setpoint value for the closed loop control system, which consists of the controller 8 with its subtracting block 7, a power amplifier 9, the transducer 3*a,b* and measuring means to measure the membrane's movement 5, e.g. the accelerometer. The output of the speed sensor is connected to the other input of the subtracting block 7 so that the actual speed value is subtracted from or compared with the calculated speed value used as setpoint value. The resulting signal is conveyed to the controller which drives via the power amplifier the transducer's membrane. The controller is dimensioned to hold the membrane's momentary speed equal to the calculated momentary speed setpoint. That means that the membrane's momentary speed depends on the momentary pressure at the membrane's surface according to a chosen mathematical function. This function is the impedance function which describes the desired relation between the effective pressure at the membrane's surface and the flow speed of the air at this surface.

It should be understood that instead of operating just with the speed also other characteristic values of the membrane's movement, e.g. acceleration and position, can be measured and used by the controller to control the movement of the membrane. The calculator can also produce more setpoint signals for movement (e.g acceleration, position) to determine the movement of the membrane.

It should be understood too that in special cases the closed loop control system can be replaced by an open loop control system if the transducer has a suitable accurate and invariant transfer function between input signal, pressure value and speed of the membrane. In this case the speed sensing means could be omitted because the speed value can be calculated based on the known transfer function and the known values of pressure and input signal. Or the direct measurement of the system variables (e.g. speed, acceleration) could be replaced by indirect measurement methods like e.g. the use observers with Kalman filters.

The calculator can be of a digital or an analog type. The controller can be of the single loop type, or a multi-variable, multi-loop controller (e.g. state-space controller) may be used.

One important characteristic of the embodiment in FIG. 1 is that its resonance frequency of the device is tunable. The device acts as a Helmholtz—resonator. The resonant frequency is mainly determined by the acoustical mass M of the air in the orifice 2

$$M=\rho*(1+1.7*R)/(\pi*R^2)$$

(with ρ being the density of air, l the length of the orifice, R the radius of the orifice),
and by the acoustical capacitance C $$C=V/(\rho*c^2)$$

of the Helmholtz resonator cavity 11 (with V being the volume of the cavity or chamber 11, c the velocity of sound in air). The resonance frequency $f_{res}$ is then given by $$(2*\pi*f_{res})^2=1/(M*C) \quad (1)$$

At this frequency the device will resonate if it is excited by sound waves incident at the mouth. The device will absorb the maximum amount of energy from the exciting noise field at this resonance frequency. To tune the resonance frequency first of all either the acoustical mass can be changed or the acoustical capacitance. More sophisticated methods can be chosen too. In the invented devices shown in FIG. 1 the tuning is achieved by changing the acoustical impedance at the surface of the transducer. No mechanical tuning is involved.

In a first preferred example the impedance function is chosen to change the acoustical capacitance C, i.e. the effective volume, of the cavity. This is achieved by controlling the momentary speed v of the transducer's membrane according to the impedance function:

$$v=K*dp/dt \quad (1)$$

with v as momentary speed value v(t) of the membrane (with the positive direction shown in FIG. 1), p as momentary pressure value p(t) and K a constant, chosen factor. With v=ds/dt, where s is the excursion of the membrane, equation (1) becomes $$ds/dt=K*dp/dt \quad (2)$$

which leads after multiplication with the effective transducer area A and the time increment dt to $$A*ds=dV=K*dp \quad (3)$$

(3) can be interpreted as follows: A pressure increment dp in the absorber's cavity causes a displaced volume K*dp at the transducer's membrane, so the transducer acts as if it were an additional cavity into which air or gas with a volume K*dp and the mass $m_{out}=\rho*dV=\rho*K*dp=K_1*dp$ flows (with ρ being the specific mass of air). This additional virtual cavity increases the overall effective resonant volume of the Helmholtz resonanace Effective means here dynamically effective (changing the "spring constant" of the system). That means that the resonance frequency is decreased. If the factor K is chosen to be negative the effective resonant volume is decreased and the resonant frequency is increased.

In the following the effective (e.g. simulated) volume is calculated. To cause a differential pressure change dp in the cavity an "input" mass $dm_{in}$ of air or gas must flow through the orifice into the cavity. The mass $dm_{out}$ then flows out into the additional volume created by the movement of the transducer's membrane, so the additional mass $dm_{in}-dm_{out}$ remains in the cavity and changes the pressure.

With p/ρ=R*T=U=constant (R being the gas constant, ρ being the density), follows $$dp=U*d\rho=U*(dm_{in}-dm_{out})/V=U*(dm_{in}-K_1*dp)/V, \quad (4)$$

so $$dp(1+U*K_1/V)=U*dm_{in}/V \quad (5)$$

and $$dp=U*dm_{in}/(V*(130\ U*K_1/V))=U*dm_{in}/V_{eff}, \quad (6)$$

so the effective volume is $$V_{eff}=V*(1+U*K_1/V)=V+U*\rho*K_1, \quad (7)$$

it has been changed by the amount $U*\rho*K_1$.

The impedance function of (1) may be supplemented with a term for energy absorption, i.e. a resistive term in the impedance function. A preferred term would be $$v_R=(p-p_0)/R \quad (8)$$

with $v_R$ being an additional component of the membrane speed, R being a constant factor and $(p-p_0)$ being the momentary pressure difference between momentary pressure p and the mean pressure $p_0$, averaged over time, in the cavity. The total speed $v_T$ of the membrane would then be $$v_T=v+v_R=K*dp/dt+(p-p_0)/R. \quad (9)$$

This acoustical resistance R may be chosen to be high, because the resonant circuit transforms it at resonance frequency to considerably lower values at the orifice. So maximum absorption can be achieved. The transformation law can be calculated using the electrical equivalent circuit. At resonance frequency $f_{res}$ the resistance at $R_{res}$ the orifice is $$R_{res}=R/(1+(2*\pi*f_{res}*R*C)^2) \quad (10)$$

In a second preferred embodiment the impedance function is chosen to change the effective acoustical mass of the dynamic system:

$$dv/dt=L*(p-p_0) \quad (10)$$

so the mebrane behaves like an additional mass which is accelerated by the pressure difference $(p-p_0)$. The resonance frequency of the resonator is now determined by both masses, the air mass in the orifice and this additional mass. To calculate the resonance frequency one can use the equivalent electrical circuits with the result:

$$(2*\pi*f_{res})^2=(L_a+L_s)/(L_a*L_s*C), \quad (11)$$

where $L_a$ is the equivalent acoustical inductance and $L_s$ is the additional equivalent inductance.

Again a term for acoustical resistance may be added:

$$dv/dt=L*(p-p_0)+(1/R)*dp/dt \quad (11)$$

It is now interesting to see which of the two solutions would allow lower excursions of the transducers membrane at a given resonator. The resonance frequency is given by the product of acoustical mass and acoustical capacitance according to (1). So for a given natural (untuned) frequency a large acoustical mass coupled to a small acoustical capacitor may be used or a small mass with a large capacitor, both solutions give the same results. With a small "natural" acoustical capacitance the simulation of an additional capacitance would allow small excursions, or at a small acoustical mass the simulation of an additional acoustical mass would result in small excursions.

In a third embodiment the impedance function contains factors or terms which change periodically in time, independently of the applied noise signal. So the simulated impedance or parts of it changes in time too. For example a sinus function with frequency f may be superimposed by multiplication:

$$v=K*\sin(2*\pi*f*t)*p+L*dp/dt \quad (12)$$

The term "K*sin(2*π*f*t)*p" modulates the system's response with the frequency f. This will change the effective resonance frequency of the system: If, for example, the noise signal is a pure sinus function too, with the frequency $f_n$, the system response will contain two new frequencies, $f_n$−f, $f_n$+f. The modulating frequency f will be chosen such that one of the produced sideband frequencies equals the resonance frequency of the system.

Figure 2:
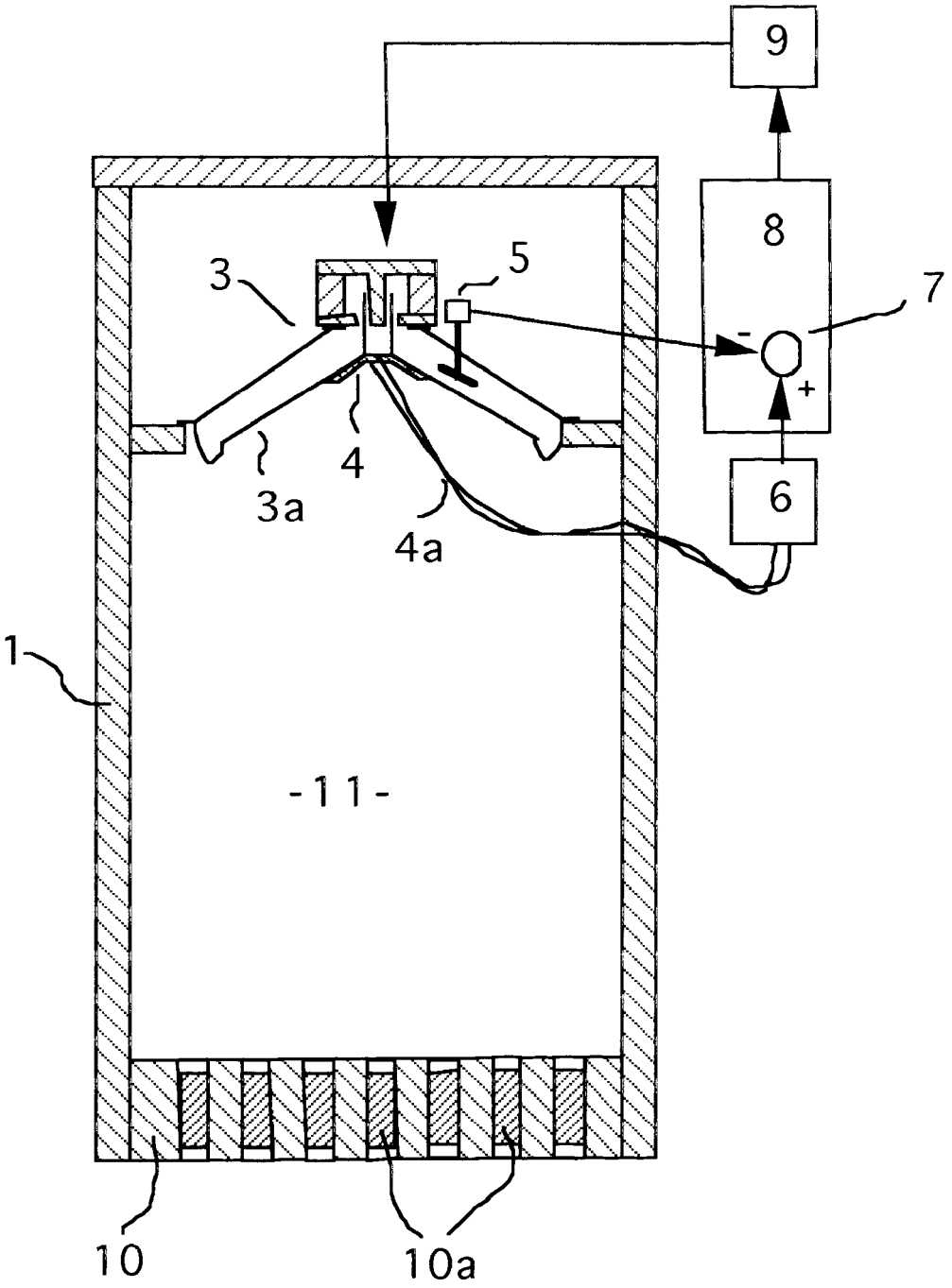
FIG. 2 shows an absorber working with a transmission line.

In a fourth embodiment according to FIG. 2 the resonator is not of the Helmholz—type but is a pipe resonator. According to the principles of the acoustical transmission line with standing waves a low pressure, high speeed amplitude at the open mouth of the pipe will be transformed into a high pressure amplitude at the closed end of the pipe. For the fundamental resonant frequency the length l of the closed pipe equals one quarter of the wavelength of the acoustical wave with frequency f.

$$l=\lambda/4=c/(4*f) \quad (13)$$

so $$f=c/(4*l) \quad (14)$$

For 1 kHz resonant frequency the length would be approx. 80 mm. The resonant overtones are the odd harmonics of the fundamental frequency f: 3f, 5f, 7f. In the embodiment according to FIG. 2 the electroacoustic transducer 3 (for example an electrodynamic transducer) is mounted at one end of the pipe 1 and closes it. The other end of the pipe 1 is semi-closed by protecting and sound absorbing material 11*a*. This material is stuffed into openings of a rigid plate 11. It absorbs higher frequency sound and works as heat and dust shield. Pressure sensing means 4 and, if needed, speed sensing means 5 are mounted at the membrane. Together with calculating means 7, a controller 8, comprising, if needed, comparing means 7, and amplifying means 9 a device for simulation of an acoustical impedance is formed in analogy to the first embodiment as already described above.

To tune the pipe-absorber with a real length $l_r$ to other frequencies $f_r$ than the fundamental frequency and its overtones the simulated impedance at the transducer's membrane is chosen to equal the acoustical impedance at the mouth of a simulated pipe which has the additional length $l_s$. So if the real length is $l_r$ and the desired resonant frequency is $f_r$ the transducer must simulate a closed pipe with length $l_s$ according to (15):

$$l_s=(c/(4*f_r))-l_r \quad (15)$$

To simulate this length of the pipe either an appropriate model of this pipe with length is may be used or a calculator or a processor, together with A/D-converters and D/A-converters may be used. In the preferred embodiment an electrical model or software model is used. The pressure at the mouth of this pipe $l_s$ is equivalent to the voltage "u", and the speed of the mebrane is equivalent to the current "i", $L_1 \ldots L_n$ are inductances equivalent to the acoustical mass elements of the transmission line (or pipe), $C_1 \ldots C_n$ are capacitances equivalent to the acoustical capacitances. In the electrical model the voltage u is applied at the input and the current i is measured. The value of u is proportional to the measured pressure, and the value of i is proportional to the required speed of the membrane. This value is applied as setpoint value to the controller.

Alternatively a digital processor may be, employed which calculates the solutions of the differential equations of the transmission line. The real length $l_r$ should preferably be chosen to equal the natural resonant length l as close as possible, so that the simulated length of pipe does not exceed one eighth of the wavelength of the desired resonant frequency. This is to avoid large excursions of the transducer's membrane. Again a resistive term for absorption may be introduced into the simulated impedance.

Figure 3:
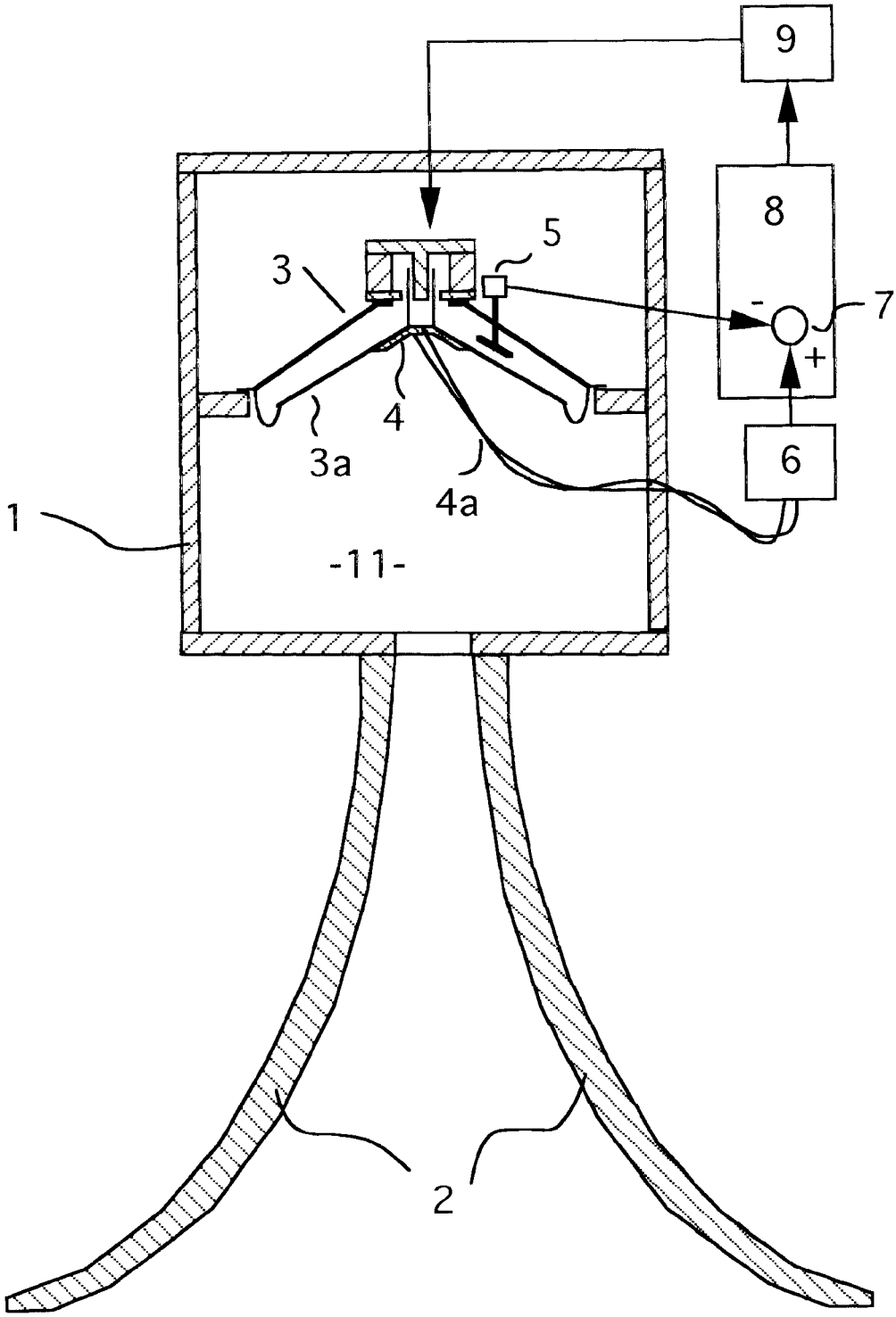
FIG. 3 shows an absorber working with a horn.

In a further embodiment of the invention according to FIG. 3 a flared acoustical horn 2 is used for the transformation of the acoustical impedances. The high acoustical impedance at the transducer's membrane at the narrow throat of the horn is translated into a low impedance at the wide mouth of the horn such that incident sound waves are absorbed well. To maximize absorption (i.e. to minimize reflections) the impedance at the mouth must equal or be close to the acoustical impedance of the surrounding.

The horn can be considered as a special case of a pipe, again showing resonance frequencies which depend on the dimensions, e.g. on the length of the horn (see e.g. Olson, H. F., "Acoustical Engineering"). So by selecting appropriate simulated impedances the horn can be tuned again by simulating e.g. a longer horn. It should be understood that folded horns in different shapes may be used. And it should be understood that combinations of acoustical transformers may be used, e.g. a horn with a Helmholz absorber.

It should be understood too, that the invention comprises also non-tunable devices which are just optimized for certain frequencies or frequency bands. In this case the simulated acoustical impedance is adapted optimally for the chosen acoustical transformer.

Additionally, in all cases passive absorbent materials may be used to absorb acoustical energie.

While the present invention has be en described in connection with particular embodiments thereof, it will be understood by those skilled in the art that many changes and modifications may be made without departing from the true spirit and scope of the present invention. This changes-concern variations of simulated impedance functions, and variations and combinations of the mechanical shapes and types of the resonators. Therefore, it is intended by the appended claims to cover all such changes and modifications which come within the true spirit and scope of this invention.

What is claimed is:

1. Active sound absorber, comprising a) an acoustical transformer, b) a device for simulation of an acoustical impedance, which comprises c) an electroacoustical transducer with a membrane, wherein said membrane is acoustically coupled to said acoustical transformer, d) pressure sensing means, being arranged within said acoustical transformer substantially close to said transducer's membrane, for measuring the air pressure and producing signals indicative of said air pressure, e) driving means, for moving said transducer's membrane with a momentary membrane speed which depends on said measured air pressure according to a predetermined impedance function, wherein said driving means receive said signals produced by said pressure sensing means, wherein said acoustical transformer and said device for simulation of an acoustical impedance are dimensioned such that said sound absorber is an acoustical resonator with predetermined resonance frequencies.

2. Device of claim 1, in which said acoustical transformer is a Helmholz resonator, and in which said pressure sensing means is arranged within said Helmholz resonator's cavity.

3. Device of claim 1, in which said acoustical transformer is a pipe resonator.

4. Device of claim 1, in which said acoustical transformer is an acoustical horn.

5. Device of claim 1, in which said acoustical transformer is an acoustical transmission line.

6. Device of claim 1, in which said acoustical transformer is a combination of at least two devices selected from the group consisting of the acoustical horn and the pipe resonator and the Helmholtz-resonator and the acoustical transmission line.

7. Device of claim 1, wherein said impedance function is adaptable.

8. Device of claim 1, wherein said impedance function contains terms which change periodically.

9. Device of claim 1, wherein said driving means comprise a) a controller, which receives said signals produced by said pressure sensing means, b) a power amplifier, which receives signals from said controller and which drives said electroacousticaltransducer.

10. Device of claim 9, in which said acoustical transformer is a device selected from the group consisting of the acoustical horn and the pipe resonator and the Helmholtz-resonator and the acoustical transmission line.

11. Device of claim 9, in which said acoustical transformer is a combination of at least two devices selected from the group consisting of the acoustical horn and the pipe resonator and the Helmholtz-resonator and the acoustical transmission line.

12. Device of claim 1, wherein said driving means is a closed-loop control system, further comprising a) movement measuring means for measuring the movement of said transducer's membrane and producing signals indicative of said movement, b) calculating means, which receive the signals produced by said pressure sensing means, for calculating setpoint values for movement, wherein the setpoint values for movement are calculated from said signals produced by said pressure measuring means in accordance to a predetermined impedance function, c) a controller, which receives said signals produced by said movement measuring means and said setpoint values produced by said calculating means, d) a power amplifier, which receives signals from said controller and which drives said electroacousticaltransducer, wherein said controller is dimensioned to drive via said power amplifier said transducer's membrane such that the actual values of movement of said membrane are substantially equal to said setpoint values of movement, and wherein said resonance frequencies are tunable by changing said impedance function of said device for simulation of an acoustical impedance.

13. Device of claim 12, in which said acoustical transformer is a device selected from the group consisting of the acoustical horn and the pipe resonator and the Helmholtz-resonator and the acoustical transmission line.

14. Device of claim 13, wherein said impedance function is electronically adaptable.

15. Device of claim 13, wherein said impedance function contains terms which change periodically.

16. Device of claim 12, in which said acoustical transformer is a combination of at least two devices selected from the group consisting of the acoustical horn and the pipe resonator and the Helmholtz-resonator and the acoustical transmission line.

17. Device of claim 16, wherein said impedance function is adaptable.

18. Device of claim 16, wherein said impedance function contains terms which change periodically.

19. Method for tuning the resonance frequency of a resonant sound absorber, comprising the step of acoustically coupling an acoustical transformer to a device for simulation of an acoustical impedance, which further comprises the steps of a) arranging an electro-acoustical transducer with a membrane, such that said membrane is acoustically coupled to said acoustical transformer, b) arranging pressure sensing means within said acoustical transformer , for measuring the air pressure and producing signals indicative of said air pressure, c) arranging driving means, for moving said transducer's membrane with a momentary membrane speed which depends on said measured air pressure according to a predetermined impedance function, wherein said driving means receive said signals produced by said-pressure sensing means, d) dimensioning said acoustical transformer and said driving means such that the device works as acoustical resonator at predetermined resonance frequencies, e) tuning said resonance frequencies by adapting said driving means.

20. Method according to claim 19, further comprising the steps of a) arranging movement measuring means for measuring the movement of said transducer's membrane and producing signals indicative of said movement, b) arranging calculating means, which receive the signals produced by said pressure sensing means, for calculating setpoint values for movement, wherein the setpoint values for movement are calculated from said signals produced by said pressure measuring means in accordance to a predetermined impedance function, c) arranging a power amplifier, which drives said electroacousticaltransducer, d) arranging a controller, which receives said signals produced by said movement measuring means and said setpoint values produced by said calculating means, which drives said power amplifier such that the actual values of movement of said transducer's membrane are substantially equal to said setpoint values of movement, e) dimensioning said acoustical transformer and said driving means such that the device works as acoustical resonator at predetermined resonance frequencies, f) tuning said resonance frequencies by adapting said impedance function.

21. Method for transforming the acoustical impedance of a device for simulation of an acoustical impedance to other values, comprising the step of acoustically coupling an acoustical transformer to a device for simulation of an acoustical impedance, which further comprises the steps of a) arranging an electro-acoustical transducer with a membrane, such that said membrane is acoustically coupled to said acoustical transformer, b) arranging pressure sensing means within said acoustical transformer, for measuring the air pressure and producing signals indicative of said air pressure, c) arranging driving means, for moving said transducer's membrane with a momentary membrane speed which depends on said measured air pressure according to a predetermined impedance function, wherein said driving means receive said signals produced by said pressure sensing means, d) dimensioning said acoustical transformer and said driving means such that the device works as acoustical resonator at predetermined resonance frequencies.

* * * * *